United States Patent [19]

Dabrowski et al.

[11] 4,388,854

[45] Jun. 21, 1983

[54] AMMUNITION STORAGE AND TRANSFER MECHANISM

[75] Inventors: Joseph M. Dabrowski, Oakland County; Valentine P. Daubar, Wayne County; Richard H. Fryer, Oakland County; John Geraltowski; James R. Underwood, both of Macomb County; Roger K. Waid; Jaunutis B. Gilvydis, both of Oakland County, all of Mich.

[73] Assignee: The United States of America as represented by the Secretary of the Army, Washington, D.C.

[21] Appl. No.: 238,313

[22] Filed: Feb. 26, 1981

[51] Int. Cl.[3] ..... F41F 9/06

[52] U.S. Cl. ..... 89/46; 89/34; 89/47; 89/36 K

[58] Field of Search ..... 89/33 SF, 33 A, 33 B, 89/34, 36 H, 36 K, 45, 46, 47

[56] References Cited

U.S. PATENT DOCUMENTS

| | | | |
|---|---|---|---|
| 3,241,447 | 3/1966 | Christiansson | 89/47 |
| 3,331,281 | 7/1967 | Jafvert | 89/33 B |
| 3,724,324 | 4/1973 | Zielinski | 89/36 K |
| 3,986,432 | 10/1976 | Schreckenberg | 89/36 K |

FOREIGN PATENT DOCUMENTS

| | | | |
|---|---|---|---|
| 2028984 | 3/1980 | United Kingdom | 89/46 |

*Primary Examiner*—Stephen C. Bentley

*Attorney, Agent, or Firm*—Peter A. Taucher; John E. McRae; Nathan Edelberg

[57] ABSTRACT

A military tank having a turret, a gun mounted in the forward portion of the turret, and ammunition storage magazines in the rear portion of the turret. A loader is arranged within the turret in alignment with the gun to transfer individual rounds of ammunition from the magazine area into the gun. The arrangement provides a compact storage system capable of storing a relatively large number of rounds in a given height turret.

7 Claims, 18 Drawing Figures

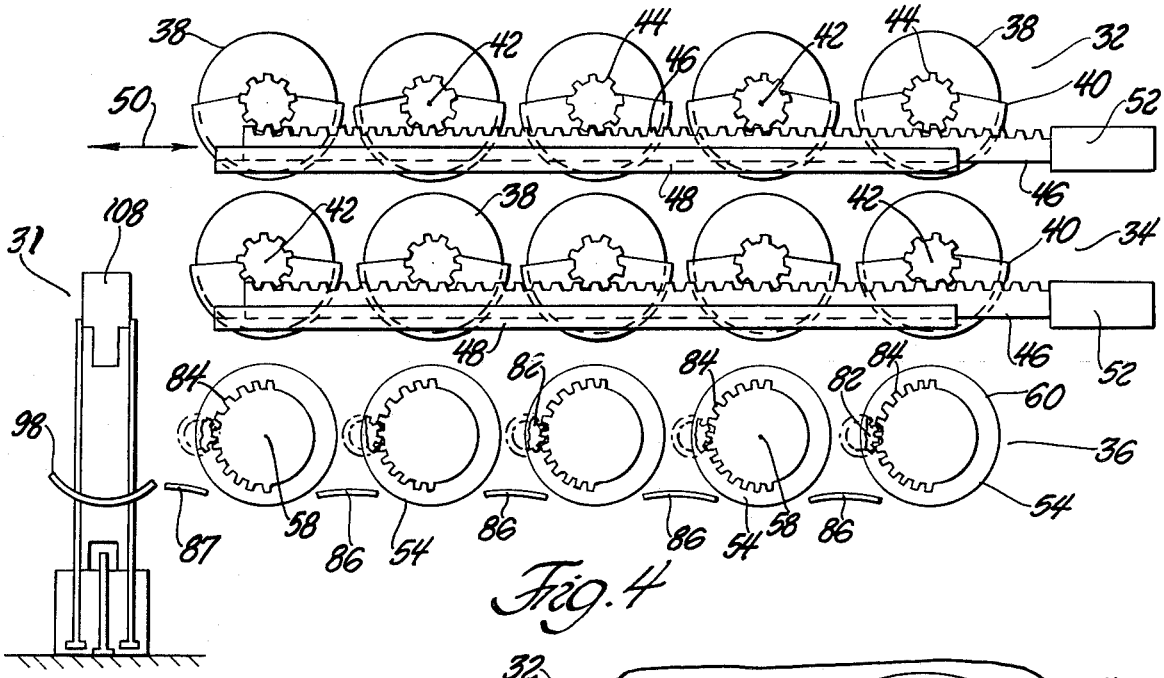
Fig. 4
Fig. 5A
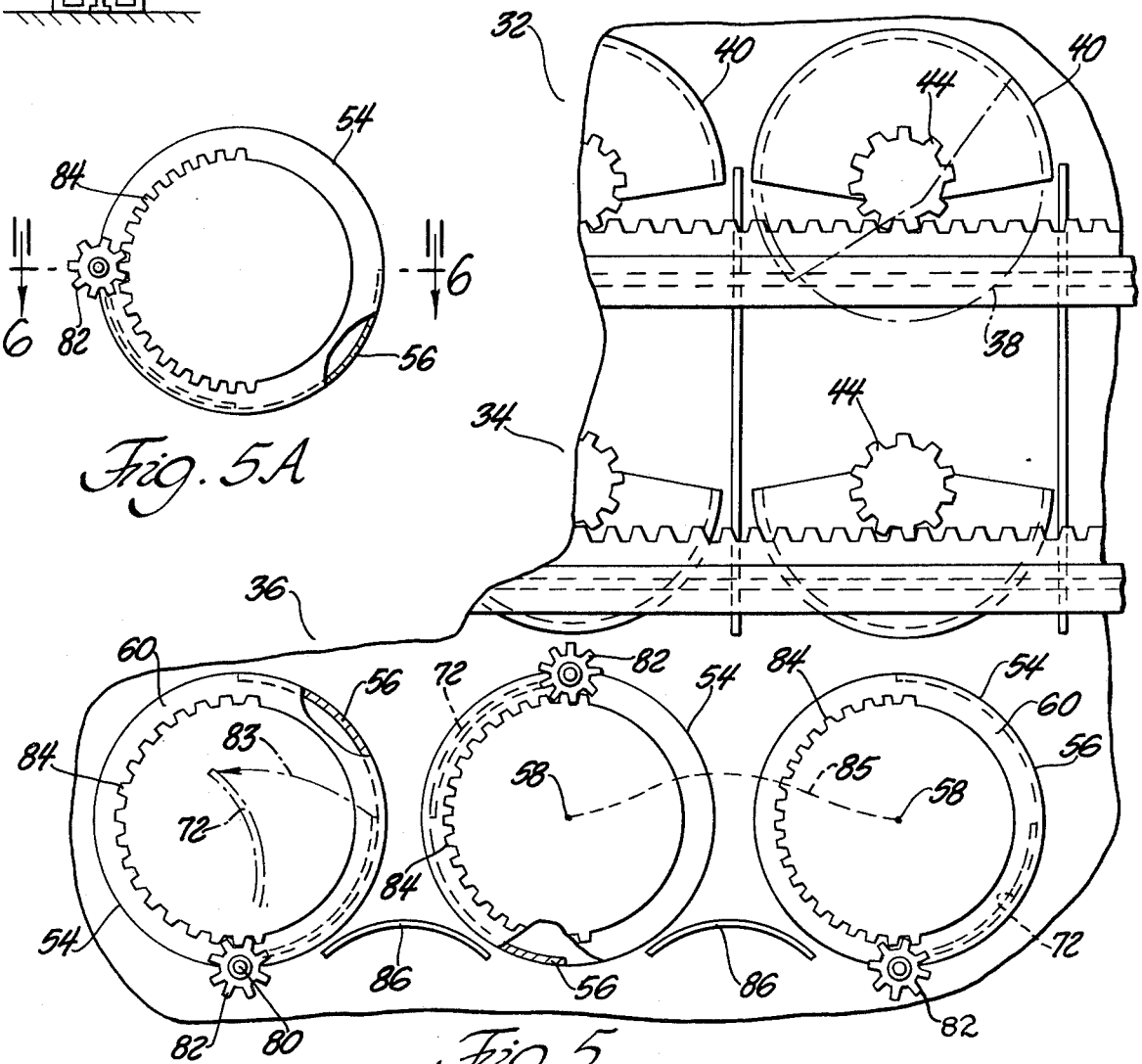
Fig. 5

AMMUNITION STORAGE AND TRANSFER MECHANISM

The invention described herein may be manufactured, used, and licensed by or for the Government for governmental purposes without payment to us of any royalty thereon.

BACKGROUND AND SUMMARY OF THE INVENTION

This invention relates to ammunition transfer mechanism for use in turrets of military tanks. The mechanism can be actuated hydraulically or electrically to sequentially transfer individual rounds of ammunition from magazines at the rear of the turret into the firing chamber of the gun without human effort or assistance other than actuation of the control system. In some respects our invention achieves the same aims as the construction shown in U.S. Pat. No. 3,724,324 issued to E. Zielinski, although our invention is believed to be an improvement over Zielinski in that we are able to store a greater number of ammunition rounds in a given size turret, and we are able to achieve completely automatic ammunition transfer from the magazine into the gun; the Zielinski construction apparently requires the services of a human loader to place each round in the firing chamber.

A principal aim of our invention is to store a relatively large number of ammunition rounds in the rear section of a turret, and to achieve automatic transfer of individual rounds into the gun in a minimum time period, preferably less than 4 seconds. A further object is to subdivide the storage magazine system into two separate magazines adapted to contain different types of ammunition, whereby the gunner can selectively transfer ammunition from either magazine into the gun in accordance with monetary battlefield requirements.

THE DRAWINGS

FIG. 4 is an enlarged view taken on line 4—4 in FIG. 1 and showing certain features of an ammunition storage magazine incorporating our invention.

FIGS. 5 and 5A are enlarged fragmentary views of the FIG. 4 magazine illustrating structural details.

Figure 13:
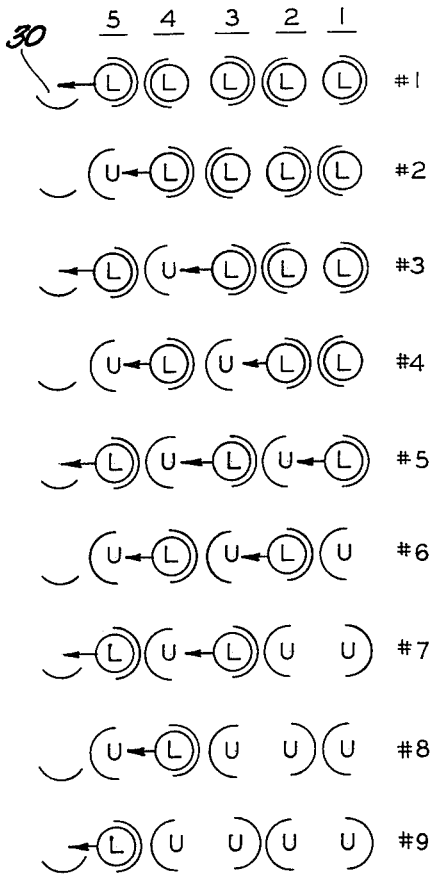

FIG. 13 diagrammatically illustrates ammunition transfer action within a magazine under practice of our invention.

Figure 14:
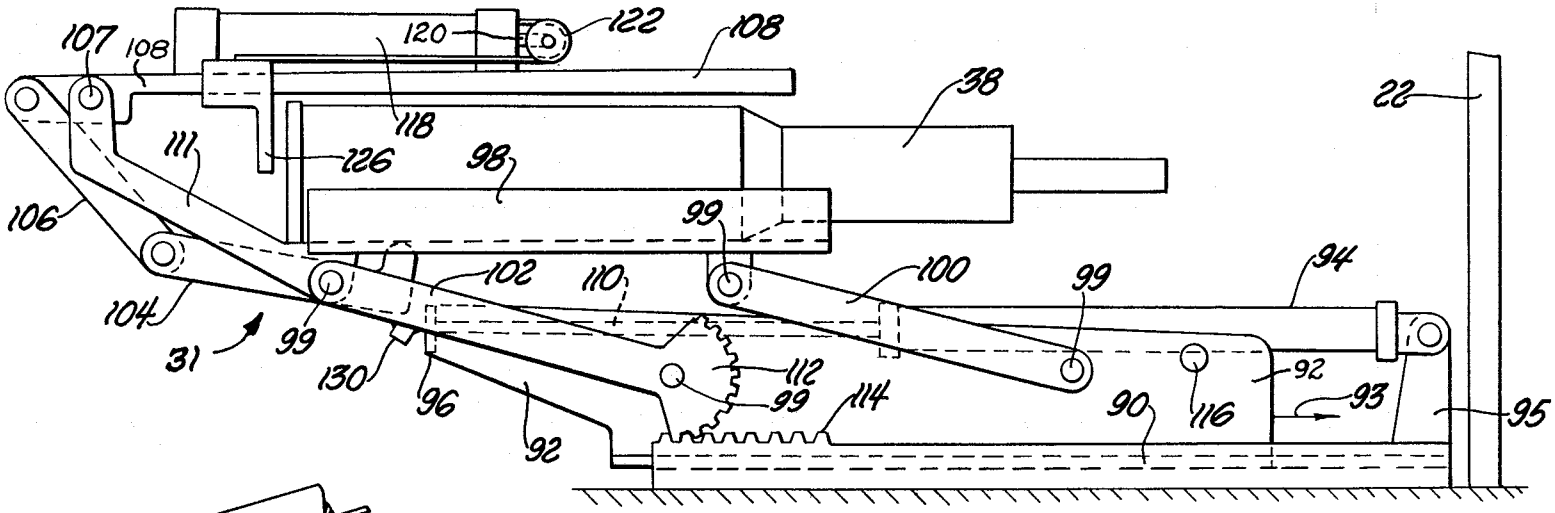

FIG. 14 is a side elevational view of a loader embodying our invention.

Figure 15:
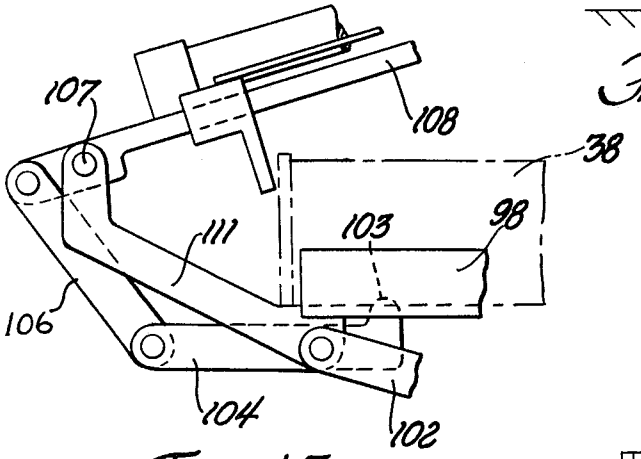

FIG. 15 fragmentarily illustrates the FIG. 14 loader in a different condition of adjustment.

Figure 16:
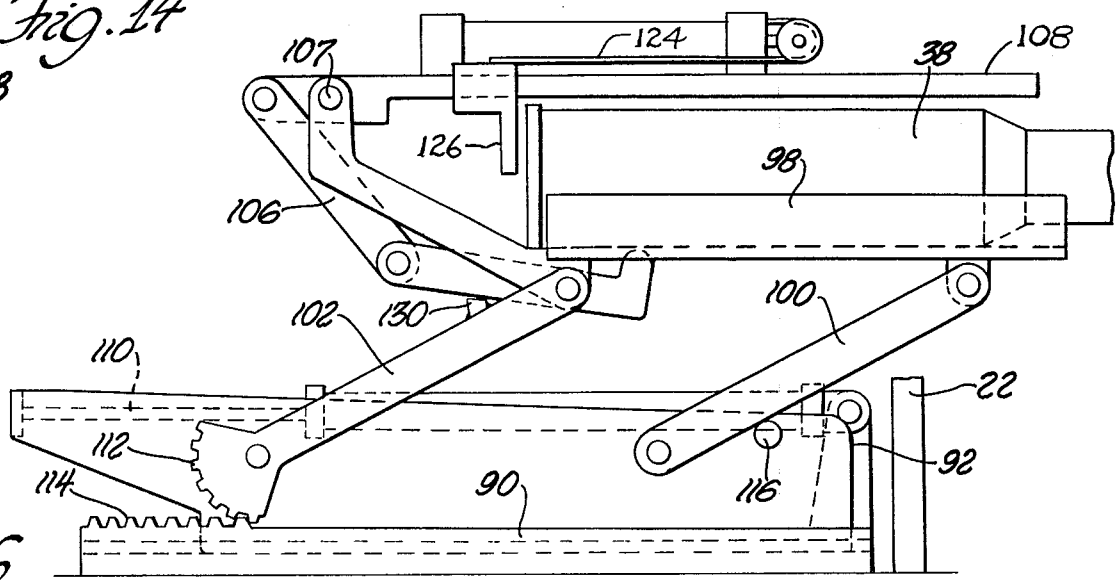

FIG. 16 illustrates the FIG. 14 loader in a condition part way through its stroke for transferring a round of ammunition into the gun.

Figure 17:
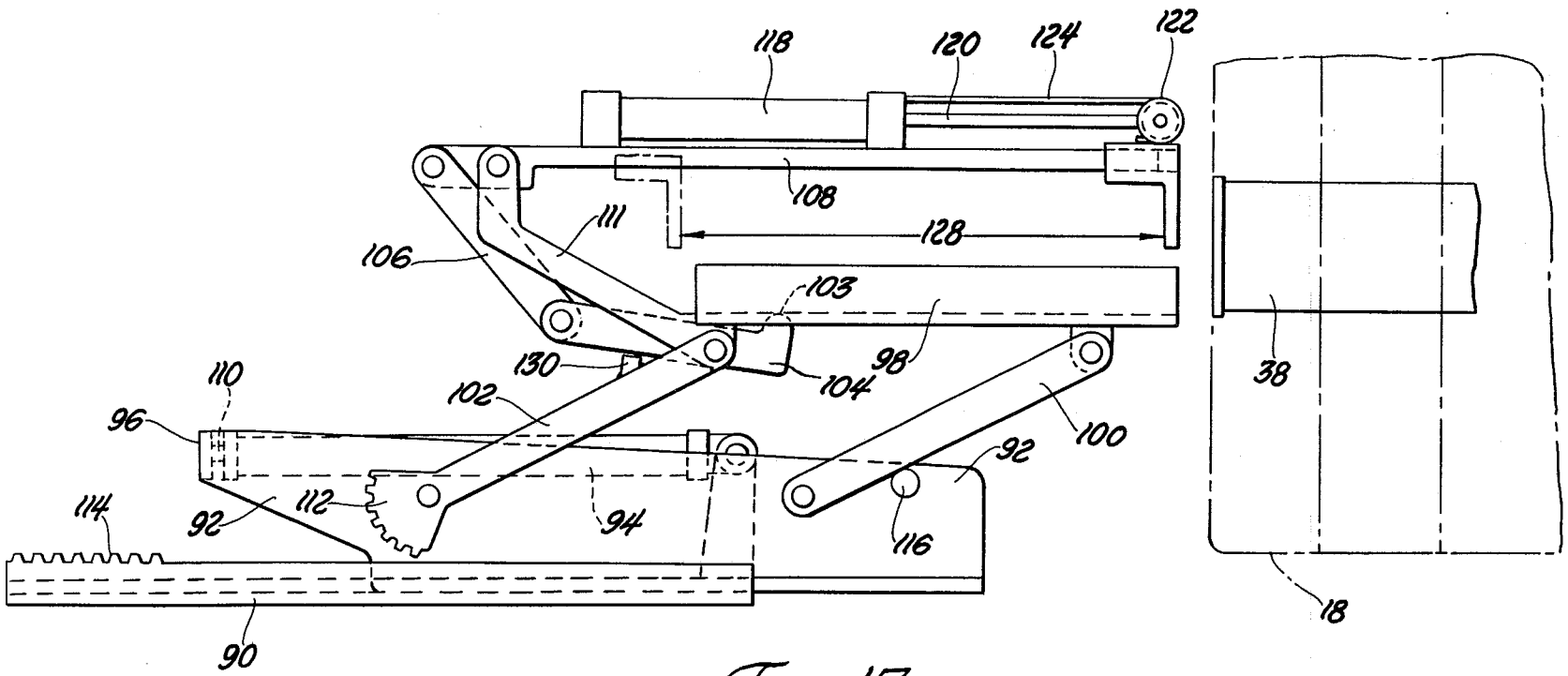

FIG. 17 shows the FIG. 16 loader at the end of its stroke as it rams the ammunition round into the gun.

Figure 1:
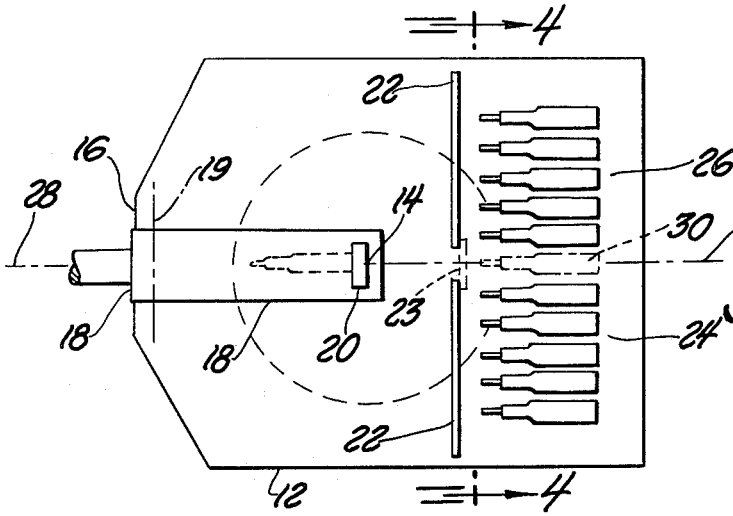
FIG. 1 is a top plan view of a turret for a military tank, showing the positionment of ammunition rounds therein under the practice of our invention.
Figure 3:
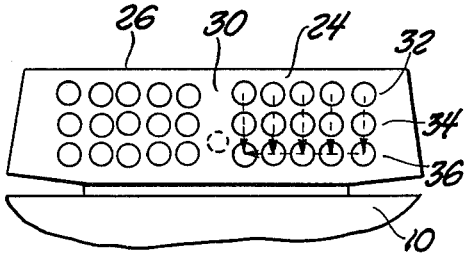
FIG. 3 is a view taken generally along line 3—3 in FIG. 2.
Figure 2:
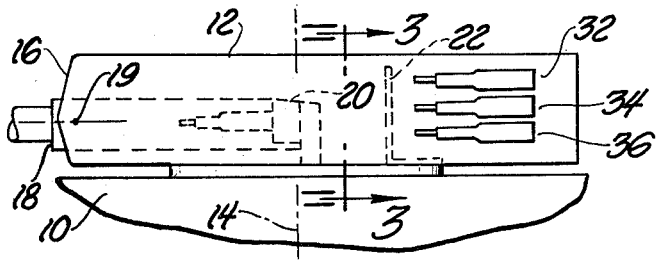
FIG. 2 is a side elevational view of the FIG. 1 turret.

Referring to FIGS. 1 through 3, there is diagrammatically shown a military tank comprising a hull 10, and turret 12 rotatable in the aximuth plane around a central axis 14. Front wall 16 of the turret mounts a large caliber gun 18, e.g. 120 mm, for adjustment in the elevational plane around transverse axis 19. The gun includes a firing chamber closed at its rear end by means of a vertically sliding breech block 20. Individual rounds of ammunition are stored rearwardly of the gun behind a stationary wall 22 that provides a measure of fratricide protection to the commander and/or gunner in the forward portion of the turret in the event that stored ammunition is detonated. As shown in the drawings, the ammunition is stored in two separate magazines 24 and 26 spaced laterally from an imaginary vertical plane 28 coincident with the axis of gun 18, thus providing a space 30 between the magazines for accommodating a loader 31, not visible in FIGS. 1-3 but shown in FIGS. 14 through 17. The loader is intended to transfer an individual round of ammunition from central space 30 forwardly into the firing chamber of the gun, i.e. between the two dashed line positions in FIG. 1.

Each of the two magazines 24 and 26 is designed to store fifteen rounds of ammunition in a three-row configuration, i.e. an upper row designated by numeral 32, an intermediate row designated by numeral 34, and a lower row designated by numeral 36. The individual magazine is designed so that individual rounds in the lower row 36 will be sequentially advanced toward loader space 30 that is aligned with the gun; the loader receives the round of ammunition at the inner end of row 36 and transfers the round forwardly into the gun. When all of the spaces in row 36 are vacant new rounds of ammunition are transferred downwardly from row 34 into the vacant spaces in row 36. Similarly all of the rounds in upper row 32 are transferred downwardly into the vacant spaces in row 34. In this way a supply of rounds is maintained for transfer from lower row 36 into the loader. Each magazine 24 or 26 is constructed similarly, except that certain components are mirror images from one another in order to provide the flow of ammunition toward central space 30. The loader in space 30 can selectively handle ammunition from the lower row 36 in either magazine 24 or 26. The different magazines can, if desired, handle different types of currently available ammunition, for example, high explosive ammunition rounds having a length of about thirty eight inches and a weight of about fifty-one pounds, or armor piercing ammunition having a length of about thirty-five inches and a weight of approximately thirty-six pounds. The individual rounds are arranged in prone attitudes generally parallel to the gun axis when the gun is set at a zero elevational attitude. During each loading cycle the gun is temporarily adjusted to the zero elevational setting while the loader is transferring a round of ammunition into the gun.

FIG. 4 illustrates features of one of the magazines 24 or 26. Individual rounds of ammunition 38 are stored in trays 40 defining the aforementioned upper rows 32 and 34. Each tray normally faces upwardly to receive a prone round of ammunition from the superjacent space above the tray. Each tray is rotatable around a horizontal axis 42 generally coincident with the axis of the supported round. One end of each tray 40 carries a pinion gear 44 that meshes with the teeth of a toothed rack 46 suitably guided in a stationary guide 48 for movement in the direction designated by numeral 50. A hydraulic cylinder 52 has its piston rod connected to rack 46, whereby introduction of pressure fluid into the right end of cylinder 52 produces leftward motion of rack 46 and resultant clockwise rotation of the associated pinion gears 44. One hundred eighty degree rotation of each pinion gear causes the associated tray 40 to overturn to the postion shown in FIG. 5, thereby enabling the round of ammunition 38 to be gravitationally discharged to the space directly below the tray. When pressure fluid is directed into the left end of cylinder 52 rack 46 is returned to its original position, thereby reversing the rotation of the associated pinion gears 44 and returning the trays 40 to their normal upwardly-facing orientations adapted to receive new rounds of ammunition from the superjacent space. The described rackpinion gear system is utilized for the upper row of ammunition 32 and also for the intermediate row of ammunition 34. Actuation of cylinder 52 for a given row will occur only when all of the spaces below the trays 40 in that row are vacant.

The lower row of ammunition, designated by numeral 36, is contained in individual trays 54. Each tray has a trough-like lower wall 56 extending about one hundred eighty degrees around the tray horizontal axis 58 so that each tray normally faces upwardly to receive a prone round of ammunition from the superjacent space above the individual tray. Each tray may be provided with circular end walls 60 as best shown in FIGS. 6–9.

Figure 6:
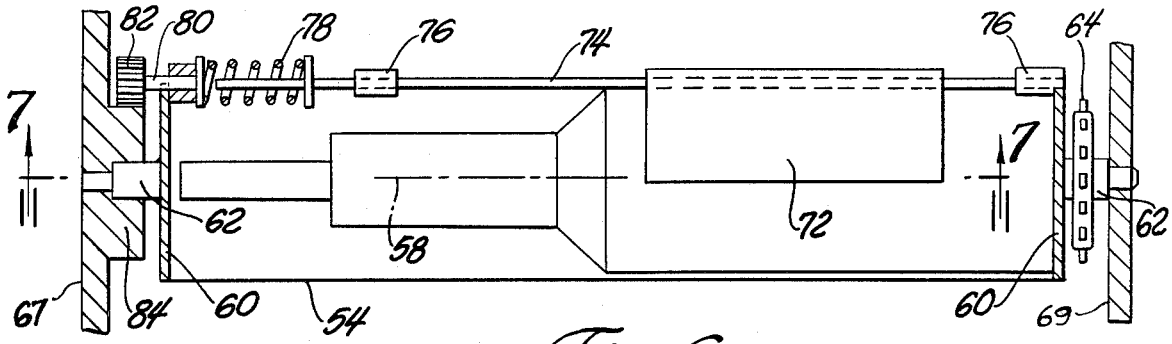
FIG. 6 is a sectional view taken on lines 6—6 in FIGS. 5 and 7.
Figure 7:
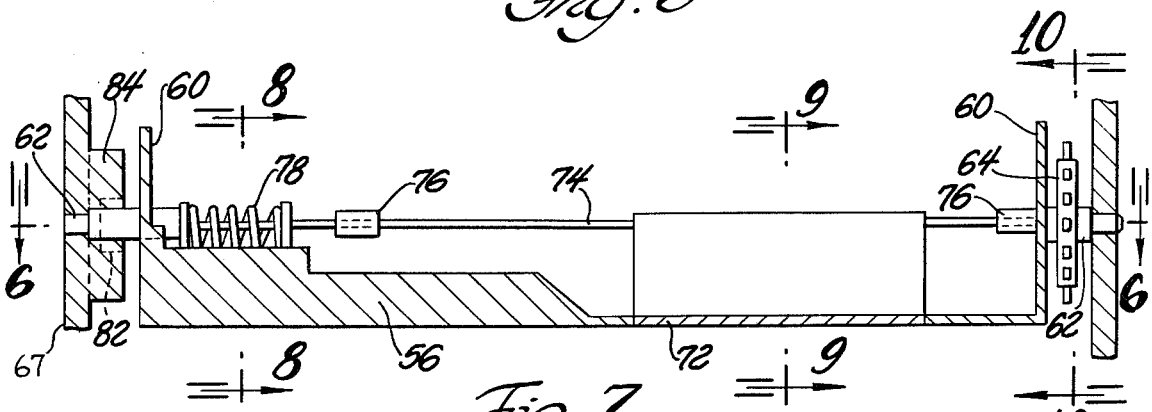
FIG. 7 is a sectional view taken on line 7—7 in FIG. 6.
Figure 8:
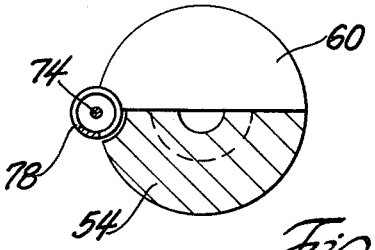
FIG. 8 is a sectional view on line 8—8 in FIG. 7.
Figure 9:
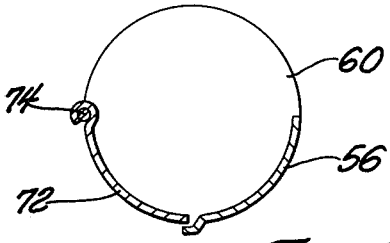
FIG. 9 is a sectional view on line 9—9 in FIG. 7.
Figure 10:
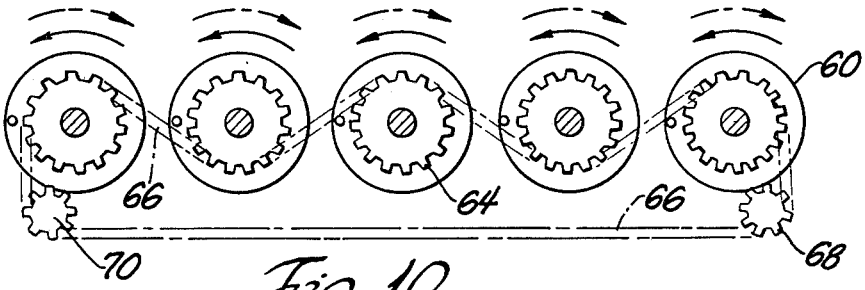
FIG. 10 is a view taken on line 10—10 in FIG. 7.
Figure 11:
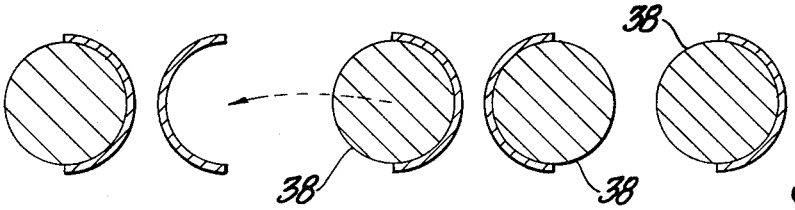
FIG. 11 is a diagrammatic illustration of the action of the ammunition transfer mechanism shown in FIG. 10.

Referring for the moment to FIGS. 6 and 7, the tray bottom wall 56 is internally contoured to the outer configuration of the ammunition round, not shown. Each tray includes stub shafts 62 that extend into circular openings in stationary walls 67 and 69 to rotatably mount the tray around horizontal axis 58. The stub shaft at the rear end of the tray carries a sprocket 64 that engages an endless chain 66 shown in FIG. 10. The chain is trained around all of the sprockets in the row of trays so that adjacent sprockets have diammetrically opposed sections thereof engaged with the chain to cause adjacent trays to rotate in opposite directions, as shown by the directional arrows in FIG. 10. Chain 66 may be driven in one direction by means of a hydraulic motor operatively connected to a small sprocket 68, and in the other direction by means of a hydraulic motor operatively connected to sprocket 70. Limit switches are provided to limit travel of the chain to a distance equivalent to approximately $\frac{1}{4}$ revolution of each sprocket 64, whereby the tray can be shifted from its normal upwardly-facing orientation to a leftwardly-facing orientation or rightwardly-facing orientation, depending on which hydraulic motor is actuated. In FIG. 5 the right-most tray 54 is shown in a leftwardly-facing orientation, the intermediate tray 54 is shown facing to the right, and the left-most tray 54 is shown facing to the left for discharge of an ammunition round to the next tray in the row. FIG. 5A shows the normal condition of tray 54 facing upwardly to receive an ammunition round from the superjacent tray in row 34. In one condition all of trays 54 in the lower row would face upwardly; in a second condition three of the five trays would face to the left and the other two intervening trays would face to the right, and in a third condition three of the trays would face to the left and the other two intervening trays would face to the right.

Each tray 54 is provided with an ejector arm or plate 72 attached to an elongated pivot shaft 74 (FIG. 6) mounted in spaced bearings 76 at one edge of the tray. Shaft 74 is connected at its forward end to a torsion spring 78 whose other end is attached to the shaft 80 of a pinion gear 82. As best seen in FIG. 5, each pinion gear 82 meshes with a stationary sector gear 84. When the tray is in the normal upright position shown in FIG. 9 torsion spring 78 is ineffective to cause ejector 72 to eject the ammunition round out of the tray. Counterclockwise rotation of tray 54 from the normal position of FIG. 5A (by means of the chain-sprocket drive system 66, 64) causes pinion gear 82 to move to the six o'clock position shown at the right of FIG. 5. Gear 82 rotates on its axis to progressively increase the loading on torsion spring 78. When the tray arrives at the six o'clock position of gear 82 the tray will face to the left and the torsion spring will exert an increased counterclockwise force on ejector 72; also at this time the ammunition round will exert a lessened gravitational force opposing ejector movement. The ejector 72 will move counterclockwise as shown by arrow 83 in FIG. 5, to transfer the ammunition round to the next tray in the row, or to the loader if the instant tray is the last tray in the row; see for example FIG. 12. Numeral 85 in FIG. 5 traces approximately the path of the centerline of the ammunition round as it is transferred from one tray to the next tray in the row. If the space to the left is occupied by a round of ammunition the round will not be ejected into that space but will merely remain in the tray. Stationary bridge plates 86 may be provided between adjacent trays to effect a smooth hang-free motion of the round from one tray to the next.

FIG. 13 diagrammatically illustrates progressive advancement of rounds, designated by the letter L (for loaded) along the lower row of the magazine toward the loader space, arbitrarily designated by numeral 30. In condition number 1 the leftmost round is ejected into the loader, as designated by the arrow. In condition number 2 the trays are reversed from the original conditions so that round number 4 is ejected to the vacant space U immediately adjacent to the loader. In condition number 3 round number 3 is ejected to the fourth vacant space, and round number 5 is ejected into the loader. The round transfer action for the other six conditions will be self-evident. In considering FIG. 13 it will be appreciated that each tray is rotated one hundred eighty degrees between successive conditions. The normal upwardly-facing orientation of each tray is not shown in FIG. 13; such a condition will be obtained when the ammunition rounds are stationary, i.e. awaiting the next transfer to loader 31 in space 30.

Loader 31 is best shown in FIGS. 12 and 14 through 17. The loader includes a linkage system that comprises a stationary fixed track 90, a slide 92 movable along the track in the arrow 93 direction toward the gun, and a fluid cylinder means 94 trained between a stationary upright post 95 and a cross-piece 96 carried by slide 92. In practice, slide 92 comprises two interconnected parallel upright plates located on opposite sides of the longitudinal center plane passing through fluid cylinder means 94.

Figure 12:
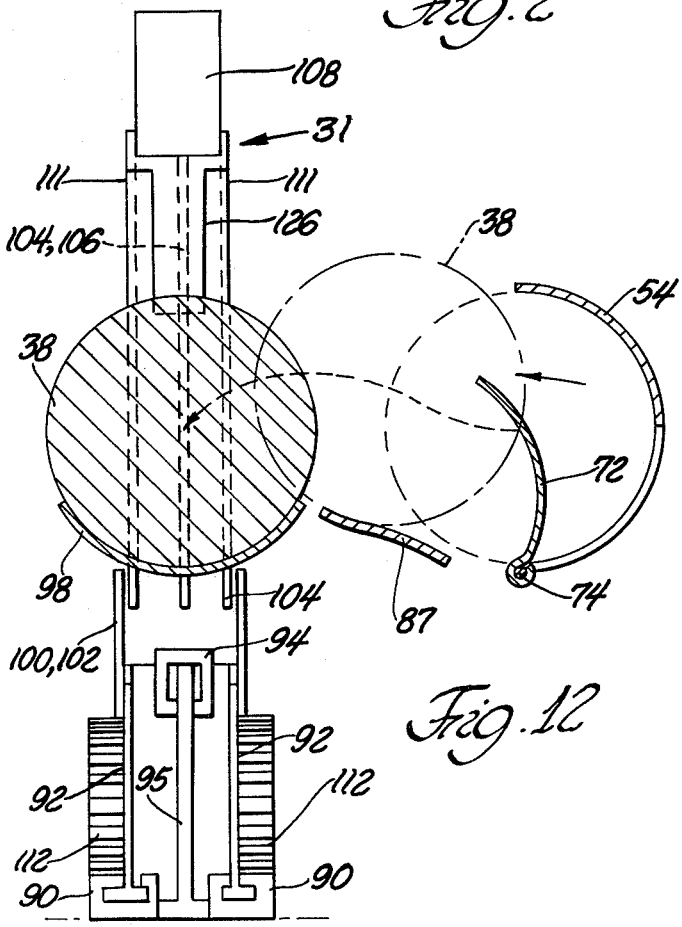
FIG. 12 illustrates how ammunition is transferred from a magazine into a loader under our invention.

The round of ammunition 38 has its undersurface supportably engaged by an upwardly facing trough 98 which is pivotally connected at 99 to parallel links 100 and 102. Links 100 and 102 have similar pivotal connections 99 with slide 92. FIG. 15 shows tray 98 prior to receiving an ammunition round 38. As the round is deposited in the tray (via the process shown in FIG. 12) the undersurface of the round contacts a finger 103 (FIG. 15) projecting from a link 104 through a slot in the wall of tray 98, thereby causing link 104 to swing in a clockwise direction to the FIG. 14 position. The link operates a second link 106 which is pivotally connected to the rear end of a round-securement arm 108 that is pivotally mounted at 107 on a support arm 111 rigidly fastened to tray 98. In the FIG. 15 position of round-securement arm 108 the space between tray 98 and the round-securement arm is relatively unobstructed to receive an incoming round from the adjacent tray 54 (FIG. 12).

Tray 54 carries an ejector arm 72 that is moved by the associated torsion spring 78 (FIG. 6) to eject the round of ammunition 38 leftwardly across a stationary ramp 87 into tray 98 of loader 31. As the round rolls into tray 98 it engages finger 103 (FIG. 15) to operate round-securement arm 108 to the FIG. 14 condition overlying the round then seated in tray 98.

Fluid cylinder 94 (FIG. 14) is actuated to move its piston rod 110 toward the gun, thereby causing each sector gear 112 to roll along stationary toothed rack 114. Crank arm 102 pivots on axis 99 of sector gear 112 to move tray 98 rightwardly to the FIG. 16 position; a stop 116 on slide 92 then limits motion of the associated link 100 and tray 98 in an arcuate sense. Stop 116 is located so that the round of ammunition 38 is in direct axial alignment with the firing chamber of the gun. Therefore continued rightward motion of piston rod 110 from its FIG. 16 position to its FIG. 17 position will advance the round partially into the gun. Each sector gear 112 is disengaged from the associated rack 14 during movement from the FIG. 16 positioned to the FIG. 17 position.

Round-securement arm 108 supports a second fluid cylinder 118 whose piston rod 120 carries two small sprockets or pulleys 122. Chains or cables 124 extend from the right end of cylinder 118 around elements 122 and leftwardly to a rammer 126 that is slidably positioned on arm 108. When tray 98 reaches the FIG. 17 position the fluid cylinder 118 is actuated to advance rammer 126 rightwardly through a stroke distance 128, thereby forcibly propelling the round 38 fully into the gun chamber, i.e. past the vertically slidable breech block. The cable-pulley connection between fluid cylinder 118 and rammer 126 enables the rammer to have a stroke distance 128 that is twice the stroke distance otherwise attainable by piston rod 120. When the components are in the FIG. 17 positioned a crossbar 130 affixed to crank arm 102 prevents link 104 from moving in a clockwise direction as might undesirably change the position of arm 108.

It will be understood that after the round has been inserted into the gun the fluid cylinders 94 and 118 are actuated in the opposite direction to return the loader to its FIG. 14 condition. Relatively light springs (not shown) may be associated with link 104 and rammer 126 to operate arm 108 to the FIG. 15 position in which tray 98 is ready to accept a new round of ammunition from magazine 24 or magazine 26.

FIG. 4 illustrates the arrangement of magazine 24 relative to loader 31. It will be understood that a second magazine 26 is arranged to the left of loader 31 so that the loader can selectively receive ammunition, either from the right or the left. Magazine 24 can be designed to store a different type of ammunition than magazine 26, whereby the commander or gunner can selectively load the gun with different ammunition from the different magazines.

FIG. 4 illustrates generally how magazine 24 (or 26) is filled and operated. The trays 40 in the upper two rows of the magazine will generally remain stationary, filled with individual rounds 38, until the trays 54 in the lower row are completely exhausted of ammunition, as by the sequence of motions illustrated in FIG. 13. When all of the trays 54 in row 36 are vacant the fluid cylinder 52 for the intermediate row of ammunition will be energized to overturn the associated trays 40 to deposit individual rounds into trays 54. Trays 54 can then undergo another sequence of motions as depicted in FIG. 13. When trays 40 in the intermediate row 34 become vacant the cylinder 52 for the uppermost row can be actuated to overturn the uppermost trays 40 for discharge of individual rounds to the subjacent trays. In this fashion it is possible to have all of the rounds gravitate into trays 54 and then laterally toward loader 31.

Each magazine 24 and 26 will include a framework for mounting the hardware shown in the drawings. The magazines can be permanently mounted in the turret, in which case ammunition can be loaded into the uppermost trays 40 in the magazine through hatch openings in the turret roof. Cylinders 52 (FIG. 4) can be actuated to sequentially advance the rounds downwardly to the subjacent trays 40 and 54. Hinged top plates normally cover the hatch openings; these plates serve as blow-out panels in event of accidental or enemy fire ignition of the ammunition. Preferably the magazine frame work is shock-mounted to the turret surfaces to minimize disturbance to the ammunition due to vehicle maneuvering. Spring tension may be applied to the upper surfaces of the rounds in trays 40 and 54 to further cushion the ammunition against road shock. FIG. 1 shows an internal partition 22 within the turret for fratricide protection of humans in the forward area of the turret. Partition 22 can be continuous across the turret except for the small central zone traversed by loader 31. Preferably a small access door 23 is provided across the loader opening. During the ammunition loading cycle a small hydraulic cylinder, not shown, may be actuated to open door 23 for a sufficient time to accomplish the cycle.

Removal of ammunition from a vehicle being taken out of service can involve removal of the upper row of ammunition through the hatch openings in the turret roof; the lower two rows of ammunition in the magazine must be removed by repetitively actuating the loader through the first stage of its cycle, i.e. to a position where each round is just ready to enter the gun. With arm 108 disengaged from the system a crew member can remove each round from tray 98.

Should the automatic loader system lose hydraulic power it is contemplated that a hand-operated pump will be located in the gunner's area to provide a manual back-up system for operating racks 46, chain 66 and cylinder 94.

The illustrated system is believed advantageous in providing a relatively compact storage-transfer system capable of housing a relatively large number of rounds in a given height turret. Another advantage of the illustrated system is its capability for selecting different type ammunition from either of two different magazines, using a single loader. The cycle can be relatively quick due to the fact that the magazine-loader design enables some operations to be performed simultaneously. For example, the operations of opening door 23, adjusting gun 18 to a zero elevational attitude, and actuating chain 66 (FIG. 10) can be performed substantially simultaneously. The principal cycle time expenditure involves loader movement from the FIG. 14 position forwardly to the FIG. 17 position and return to the starting condition prior to closure of bulkhead door 23. Total cycle time is estimated to be less than 4 seconds for a system handling individual rounds of ammunitions weighing approximately fifty pounds and having a length of about 38 inches. Energy expended during each cycle is relatively small because only a few rounds of ammunition are moved at any one moment; additionally movement of the rounds in each magazine is generally in a downward direction, with no lateral motion until the rounds are in the lower row. Round movement in the lower row of the magazine is essentially rolling movement, without any lifting requirements; energy expenditure should be relatively small. Total average motion of the individual rounds within the magazine is relatively small, thus contributing to a relatively low total power expenditure. A low power expenditure is desirable in order to conserve power for other purposes and to minimize the size and weight of the auxiliary electro-hydraulic power system located within the hull.

We wish it to be understood that we do not desire to be limited to the exact details of construction shown and described for obvious modifications will occur to a person skilled in the art.

We claim:

1. In a military tank having a turret movable in the azimuth plane, a gun mounted in the frontal area of the turret for movement in the elevational plane, and magazine means for storing ammunition within the turret in rearwardly spaced relationship to the gun; the improvement wherein said magazine means comprises two individual magazines, each arranged to support rounds of ammunition in prone attitudes generally parallel to the gun axis when said gun is at a zero elevational setting; each magazine including first means for supporting a number of rounds of ammunition in an upper row configuration, second means for supporting a number of rounds of ammunition in an intermediate row configuration, and third means for supporting a number of rounds of ammunition in a lower row configuration; the individual magazines being spaced laterally from a vertical plane coincident with the gun axis to provide an ammunition loader space between the magazines; and an ammunition loader disposed in the space between the magazines for transferring an individual round of ammunition into the gun firing chamber; the support means for the upper and intermediate rows of ammunition in each magazine comprising a series of trays normally facing upwardly to receive prone rounds from the superjacent spaces above the individual trays; each tray being rotatable around a horizontal axis generally coincident with the axis of the supported round, whereby one hundred eighty degree motion of an individual tray causes a supported round of ammunition to be gravitationally discharged to the space directly below the tray.

2. The improvement of claim 1, and further comprising individual power means for rotating the trays in the upper and intermediate rows of each magazine; each individual power means comprising a toothed rack extending transversely across the associated row of trays, and a pinion gear carried by each tray in meshing engagement with the adjacent rack.

3. In a military tank having a turret movable in the azimuth plane, a gun mounted in the frontal area of the turret for movement in the elevational plane, and magazine means for storing ammunition within the turret in rearwardly spaced relationship to the gun; the improvement wherein said magazine means comprises two individual magazines, each arranged to support rounds of ammunition in prone attitudes generally parallel to the gun axis when said gun is at a zero elevational setting; each magazine including first means for supporting a number of rounds of ammunition in an upper row configuration, second means for supporting a number of rounds of ammunition in an intermediate row configuration, and third means for supporting a number of rounds of ammunition in a lower row configuration; the individual magazines being spaced laterally from a vertical plane coincident with the gun axis to provide an ammunition loader space between the magazines; and an ammunition loader disposed in the space between the magazines for transferring an individual round of ammunition into the gun firing chamber; the support means for the lower row of ammunition in each magazine comprising a series of trays normally facing upwardly to receive prone rounds from the superjacent spaces above the individual trays; each tray being rotatable around a horizontal axis generally coincident with the axis of the supported round; and power means for rotating the trays from their normal positions about one quarter revolution in the clockwise direction or one quarter revolution in the counterclockwise direction; said power means being oriented to the trays so that all trays move simultaneously, and adjacent ones of the trays move in opposite directions; each tray having an ejector for delivering a round of ammunition from that tray to an adjacent tray when the two trays are in facing relation to one another.

4. The improvement of claim 3: each ejector being pivotally carried on the associated tray for swinging motion through the tray interior space to accomplish the round ejector action, each ejector having an operating means that includes a torsion spring arranged to be progressively loaded during motion of the tray toward a position facing the ammunition loader, whereby successive actuations of the aforementioned power means cause individual rounds of ammunition to be transferred from one tray to another in the direction of the loader.

5. The improvement of claim 3: the power means for rotating the trays in each magazine lower row comprising a sprocket carried by each tray, and a power-driven chain trained around all the sprockets in the row; adjacent sprockets having diametrically opposed sections thereof engaged with the chain to cause adjacent trays to move in opposite directions.

6. In a military tank having a turret movable in the azimuth plane, a gun mounted in the frontal area of the turret for movement in the elevational plane, and magazine means for storing ammunition within the turret in rearwardly spaced relationship to the gun; the improvement wherein said magazine means comprises two individual magazines, each arranged to support rounds of ammunition in prone attitudes generally parallel to the gun axis when said gun is at a zero elevational setting; each magazine including first means for supporting a number of rounds of ammunition in an upper row configuration, second means for supporting a number of rounds of ammunition in an intermediate row configuration, and third means for supporting a number of rounds of ammunition in a lower row configuration; the individual magazines being spaced laterally from a vertical plane coincident with the gun axis to provide an ammunition loader space between the magazines; and an ammunition loader disposed in the space between the magazines for transferring an individual round of ammunition into the gun firing chamber; said ammunition loader comprising a horizontal trough-like tray arranged to supportably engage an undersurface of the round while it is being delivered to the gun, a retractable round-securement means located above the round-support tray, means responsive to initial placement of an ammunition round in the tray for automatically moving the round-securement means downwardly to an operative position preventing upward dislodgement of the round out of the tray, a power-operated linkage for transporting the tray toward the gun whereby the tray delivers a round of ammunition to a position partially inserted into the gun firing chamber, and a rammer slidably mounted on the round-securement means for movement through the zone immediately above the tray, said rammer including means forcibly engaging the base of the round to propel the round to a position fully inserted into the gun firing chamber.

7. The improvement of claim 6: the aforementioned power-operated linkage comprising a stationary track, a slide movable along side track, fluid cylinder means trained between the track and slide for producing movement of the slide toward or away from the gun, a stationary toothed rack oriented parallel to the track; a crank arm having at one end thereof a sector gear engageable with the toothed rack, the other end of the crank arm being pivotably connected to the aforementioned tray, said sector gear having a support shaft that is affixed to the slide, whereby initial movement of the slide toward the gun causes the sector gear to rock around its shaft axis, thereby producing rotary motion of the crank arm and advancement of the tray toward the gun; the stroke of the fluid cylinder means being such that the slide can thereafter move a further distance toward the gun after the sector gear leaves the toothed rack.

* * * * *